US005575414A

United States Patent [19]

Gröninger et al.

[11] Patent Number: 5,575,414

[45] Date of Patent: Nov. 19, 1996

[54] PROCESS AND DEVICE FOR GUIDING AND KEEPING A MATERIAL WEB SPREAD

[75] Inventors: Alois Gröninger, Augsburg; Werner Geyer, Konigsbrunn; Hans Seibold, Anhausen, all of Germany

[73] Assignee: Erhardt & Leimer GmbH, Augsburg, Germany

[21] Appl. No.: 367,691

[22] Filed: Jan. 3, 1995

[30] Foreign Application Priority Data

Jan. 8, 1994 [DE] Germany ..... 44 00 389.7

[51] Int. Cl.[6] ..... B65H 23/032

[52] U.S. Cl. ..... 226/18; 226/15

[58] Field of Search ..... 226/15, 18, 1

[56] References Cited

U.S. PATENT DOCUMENTS

| | | | |
|---|---|---|---|
| 3,567,091 | 12/1968 | Woolard | 226/18 |
| 4,506,782 | 3/1985 | Jeanneret et al. | 226/18 |
| 4,739,358 | 4/1988 | Takahashi et al. | 226/18 |
| 5,098,507 | 3/1992 | Mao | 226/18 |
| 5,126,946 | 6/1992 | Ko | 226/18 |
| 5,138,341 | 8/1992 | Kobayashi | 226/15 |
| 5,208,633 | 5/1993 | Genovese | 226/18 |
| 5,284,284 | 2/1994 | Narishima et al. | 226/15 |

FOREIGN PATENT DOCUMENTS

| | | | |
|---|---|---|---|
| 1442490 | 12/1988 | U.S.S.R. | 226/15 |

*Primary Examiner*—Daniel P. Stodola
*Assistant Examiner*—Matthew A. Kaness
*Attorney, Agent, or Firm*—Collard & Roe, P.C.

[57] ABSTRACT

A process and apparatus for guiding and keeping a material web spread out uses a spreading roll and with contact pressure elements and a control member controlled by a control system monitors the control path in a way such that the spacing of the contact pressure elements from the spreading roll is varied. Because of the advantages that the control path has in the present case, a rapid and stable control of the position of the material web is assured. This is advantageous especially in connection with highly sensitive material webs such as, for example, wide-meshed textile webs.

20 Claims, 4 Drawing Sheets

PROCESS AND DEVICE FOR GUIDING AND KEEPING A MATERIAL WEB SPREAD

BACKGROUND OF THE INVENTION

1. Field of the Invention

The invention relates to a process and a device for guiding a material web and for keeping the material web spread out.

2. The Prior Art

In practical operations, various devices are known for spreading out and guiding a moving web of material. In connection, with a device known from DE-OS41 26,489, pressure elements such as belts or cords set inclined relative to the moving direction of the material web and pressing the latter against a roll entwined by such material web, produce in the material web forces, which are directed at the edges of the web and spread out the web. In addition, it is proposed to design the roll entwined by the material web as a conventional spreading roll. Guidance of the material web, thus the control of its position, is accomplished in this connection by varying the contact pressure forces of the belts in the two marginal zones of the material web by means of a force transmitter. This device suffers from the drawback that even very minor increases in the contact pressure forces trigger an over-controlling of the control system. This leads to a highly unstable control, or to a very sluggish control with adequate dimensioning of the controller. In any case, the control result achieved with such a device is unsatisfactory.

Another spreading and guiding device is known from U.S. Pat. No. 5,067,646, whose pressure elements are completely lifted off the spreading roll. When an edge sensor detects a run of the material web toward one edge, the pressure elements of the opposite marginal zone are placed on the material web, whereby such contacting takes place very gently in order to treat the material web with care. However, this two-point control has the drawback that it becomes active only when a relatively major divergence occurs. A stable and finely tuned control is not assured in this way.

SUMMARY OF THE INVENTION

It is an object of the present invention to provide a process and a device for guiding a material web and for keeping the material web spread out, which results in an effective spreading even of sensitive webs of material combined with a rapid, stable and finely tuned control of the position of their edges.

In one embodiment, the controller influences the position of the material web by changing the spacing of the contact pressure elements relative to the spreading roll, in order to control the spreading roll as closely as possible to a desired input reference value. This process exhibits a particularly favorable behavior as compared to the disadvantageous and largely sluggish or unstable influencing via the contact pressure force because of the high phase displacement of the control path. In addition to enhancing the control result, finding the optimal parameters of the controller is simplified as well, because the control route has, in the present case, a lower phase shift. This reduces the oscillation tendency of the controller, so that any sudden contact pressing of the contact pressure elements is effectively avoided, and the material web is not afflicted with any marring pressure spots.

In another embodiment, the material web is subjected to a nearly constant spreading force, which is important especially in connection with highly sensitive or highly elastic webs of material.

In a further embodiment, the spacing of the contact pressure elements is changed to a higher degree in the one marginal or end zone than in the other marginal or end zone. Although this means that the tension of the material web is changed in this way in the transverse direction, this process embodiment can be nevertheless advantageous in view of a clean and steady run of the material web. Alternatively, it would be advantageous also if the spacing of the contact pressure elements from the spreading roll is changed only in one marginal zone and maintained constant in the other marginal zone. This process is more favorable in terms of cost because of the simpler construction, and it will be basically used for solid material webs of greater material strength.

In another embodiment, positioning devices are used for the contact pressure elements instead of the force transmitters that have become known heretofore. These positioning devices set the spacing of the contact pressure elements from the spreading roll in accordance with the output signal of the controlling system. The control route has a lower phase shift due to the feedback transmission of a signal that is proportional to the position of the contact pressure elements. In turn, this permits increasing the loop gain of the controlling system especially in connection with higher frequencies. From this results a particularly stable control behavior with a very short response time. In this connection, it is necessary only to detect the position of the contact pressure elements by means of a path generator and to feed this signal to the controller. The controller compares the signals of a scanning device of the material web edge, taking into account the position of the contact pressure elements, with a desired or preset value that is kept constant, and in this way generates a correction signal, which is supplied amplified to the control member of the positioning device. This structure is very simple, on the one hand, but highly advantageous with respect to the effect, so that various control possibilities are available. Provision can be made for a scanning device with its own control unit for each edge zone of the material web, or for only one scanning device on one edge, and a control unit. Also, it is possible to build up a material web center control by linking two scanning devices acting on a common control system. Preferably, the scanning devices of the material web edges are arranged downstream of the spreading roll as closely as possible to the spreading roll in order to make the control not unnecessarily more sluggish.

In a further embodiment, due to the mechanical coupling of all contact pressure elements of one marginal or end zone on a support element, which can be designed as a shaft or a frame, only one or two control members are required for the device. If, in this connection, all contact pressure elements of a marginal zone have the same spacing from the spreading roll, the same tensioning force acts everywhere normally relative to the moving direction of the material web. This is advantageous mainly in connection with wide-meshed material webs. If the spacing of the contact pressure elements from the spreading roll increases with the increasing distance from the corresponding edge of the material web, the transverse forces of the material web increase toward the edges. This leads to a particularly favorable spreading of an elastic material web. Also, the contact pressure elements can be evenly distributed across the spreading roll in order to achieve an optimal spreading effect. In this case, the two marginal or end zones extend close to the center line of the material web.

In another embodiment, the material web is kept spread out constantly due to the synchronous setting of the contact pressure elements in the two marginal or end zones in the opposite directions. Another advantage of this embodiment is based on the increased dynamics by which problems are corrected, because the resulting guiding force acting on the material web is doubled in this way.

A favorable utilization of contact pressure elements that are synchronously adjustable in opposite directions includes a mechanical coupling of the contact pressure elements in the two marginal or end zones of the material web. In this embodiment, a special advantage is gained in that only one control member is required for both edge zones of the material web. Thus this embodiment can be utilized at particularly favorable cost without dispensing with the advantages specified above.

If more than one contact pressure element is present on each side of the material web, such elements are combined with a supporting element, for example a frame. The motion of the control member is converted into a rotary motion of its arms in the opposite direction with a connection piece, which is rotatably supported in the center. In this embodiment, the control member can, in an articulated manner, engage one of the arms, or a third arm of the connection piece via a thrust bar. Alternatively, a control member producing a rotary motion can drive the rotatable connection piece on its rotary axle directly or via a gearing. The contact pressure elements are displaced or swiveled in opposite directions by the arms of the rotary part and, in this way, assure on each side of the material web the desired spacing of the contact pressure elements from the spreading roll, and thus a smooth, continuous alignment of the moving material web.

In another embodiment, the contact pressure elements are rotatably supported and each have a jib. The force to be transmitted only leads to the desired adjustment. Jamming lateral forces are excluded by the articulated pivot bars. This embodiment is particularly favorable because the motion of a single control member is translated with low energy expenditure and with simple parts into a rotary motion in opposite directions on the contact pressure elements of the two edge zones of the material web. Thus, the cost advantage becomes evident by using only one single control member. In this embodiment, it has been found that it is highly advantageous if revolving endless belts or cords are used as contact pressure elements. If such belts or cords are set slanted relative to the moving direction of the material web, and directed at the edges, such belts by themselves generate components of force directed at the edges, which components induce a spreading effect. Most of all, depending on their spacing from the spreading roll, a variable engagement is achieved with such belts, which increases the correcting effect even further.

In a further embodiment, the stepless adjustment of the contact pressure elements, marring pressure marks are avoided on the material web when the contact pressure elements come into contact with the web, with suitable dimensioning of the controlling system. Also, it would be useful in this connection to shift the positioning device of the contact pressure elements in several predetermined stages, especially if the step width between each adjacent stage is sufficiently small. This embodiment simplifies particularly the application of digital means for realizing the control system.

In another embodiment, the signal of the edge sensor of the material web is feedback-linked in the control loop with the signal of the path generator, which measures the position of the contact pressure elements. The signal generated in this way, which is a corrected actual-value, is compared with the constant desired preset reference value and supplied to the controller as the input signal. The output signal of the controller is amplified and acts on one or a number of control members, which determine the position of the contact pressure elements. Since only one control loop per control circuit is present in this embodiment, a structure of the total system is obtained that is favorable in terms of cost and easy to put into operation.

In a further embodiment, the position control can be designed as an independent controller, which compares the position of the contact pressure elements by means of a path generator as the actual value with the desired preset reference value and generates therefrom a correction signal of the control member. Here, the output signal of the controlling system controlling the position of the material web is directly transmitted to the should-be value input of the position controller. The special advantage of this embodiment lies in that it is possible to adjust the chronological behavior of the controlling system for guiding the material web independently of the position-controlling system. Controlling of the position of the material web is generally more sluggish than controlling the position of the contact pressure elements. Thus, it is possible, with optimal adjustment of the control parameters, to control disturbances relating only to the position of the contact pressure elements such as, for example, local thickening of the material web, at a much faster rate than the control rate in connection with a combined controller.

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

DETAILED DESCRIPTION OF THE PREFERRED EMBODIMENTS

Figure 1:
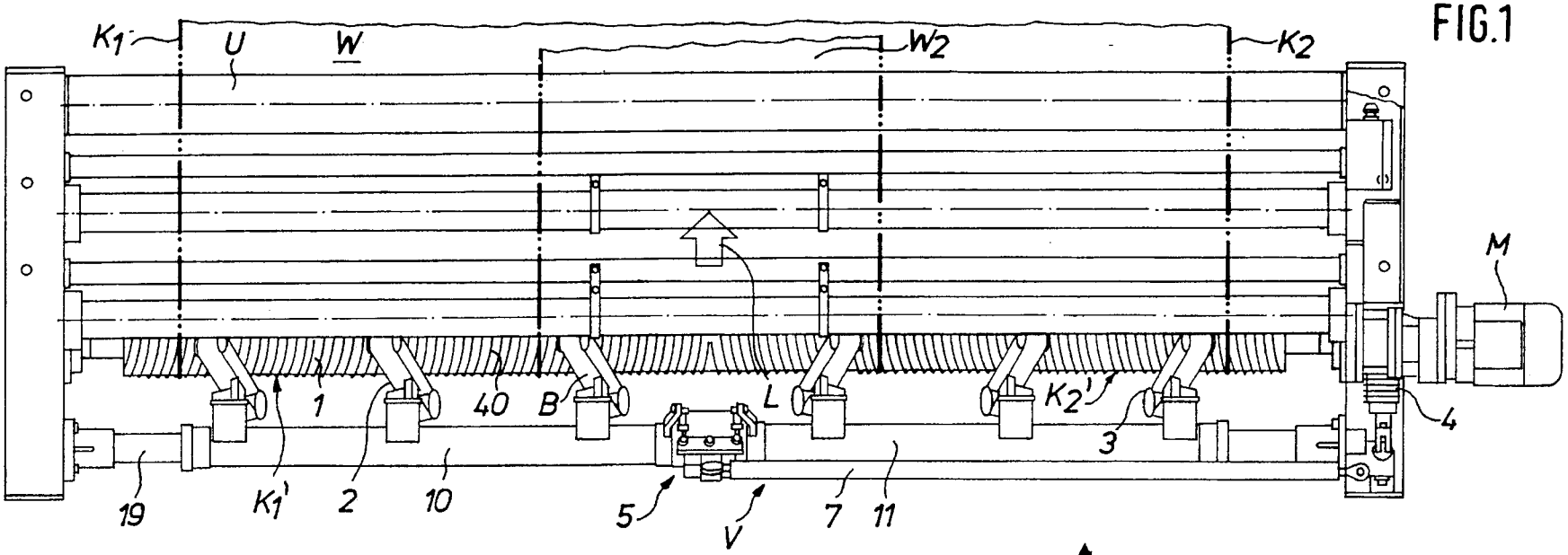
FIG. 1 shows a top view of a material web spreading and guiding device.

Turning now in detail to the drawings, FIG. 1 shows a device V for guiding and keeping a material web W spread out. The web moves in the direction of arrow L, and substantially includes a roll 1, which is designed as a spreading roll which, starting from the center, is covered by the oppositely oriented thread turns 40, and onto which the contact pressure elements 2, 3 press. The elements 2, 3 have the form of the revolving endless belts B. Alternatively, brushes, revolving endless cords, elastic rolls and rollers can be used as well. It is desirable if the contact pressure elements 2, 3 are arranged inclined outwardly vis-a-vis the roll 1, so that due to the frictional force acting between the contact pressure elements 2, 3 and the roll 1, a force component directed at the material web edge $K_1$, $K_2$ is generated. This has the effect of keeping the material web W spread out in this way. The contact pressure elements 2, 3 for the spreading roll 1 are distributed over the respective edge zones $K_1'$, $K_2'$ of the material web W and, with respect to each edge zone $K_1'$, $K_2'$ in each case rotatably supported on an axle 19 by a supporting element 10, 11, designed as a shaft. A control member 4, via a thrust bar 7, acts on a coupling device 5, which rotatably connects the two shafts 10, 11. The coupling device 5 is explained in greater detail below. It was found that it is advantageous to have the spreading roll 1 driven by a motor M in or against the material web running direction L. If necessary, the motor M is mounted flanged to the front side of the spreading roll 1 via a gearing. The drawing shows that the spreading roll 1 is followed downstream by a reversing or fixing roll U. The contact pressure elements 2, 3 are distributed on each side with respect to the spreading roll 1 with such width that material webs $W_1$, $W_2$ of varying width can be safely guided with the device V.

Figure 2:
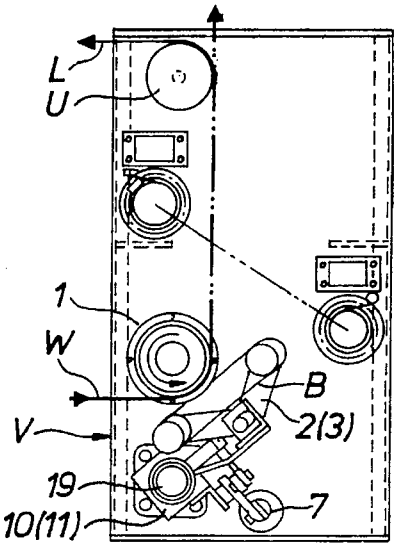
FIG. 2 shows a side view of this device of FIG. 1.

FIG. 2 shows a side view of the device V, in which the parts identical to those shown in FIG. 1 are denoted by the same reference numerals. The material web W entwines the spreading roll 1 with an angle of 90° and, upon passing the reversing or fixing roll U downstream, exits from the device V in three selectively proposed directions L. The contact pressure elements 2, 3 with the endless belt B press against the material web W within the range of reversal around the spreading roll 1. The contact pressure elements 2, 3 are fastened on the supporting elements 10, 11, which are designed as shafts, and are swivel-mounted on the axle 19.

Figure 3:
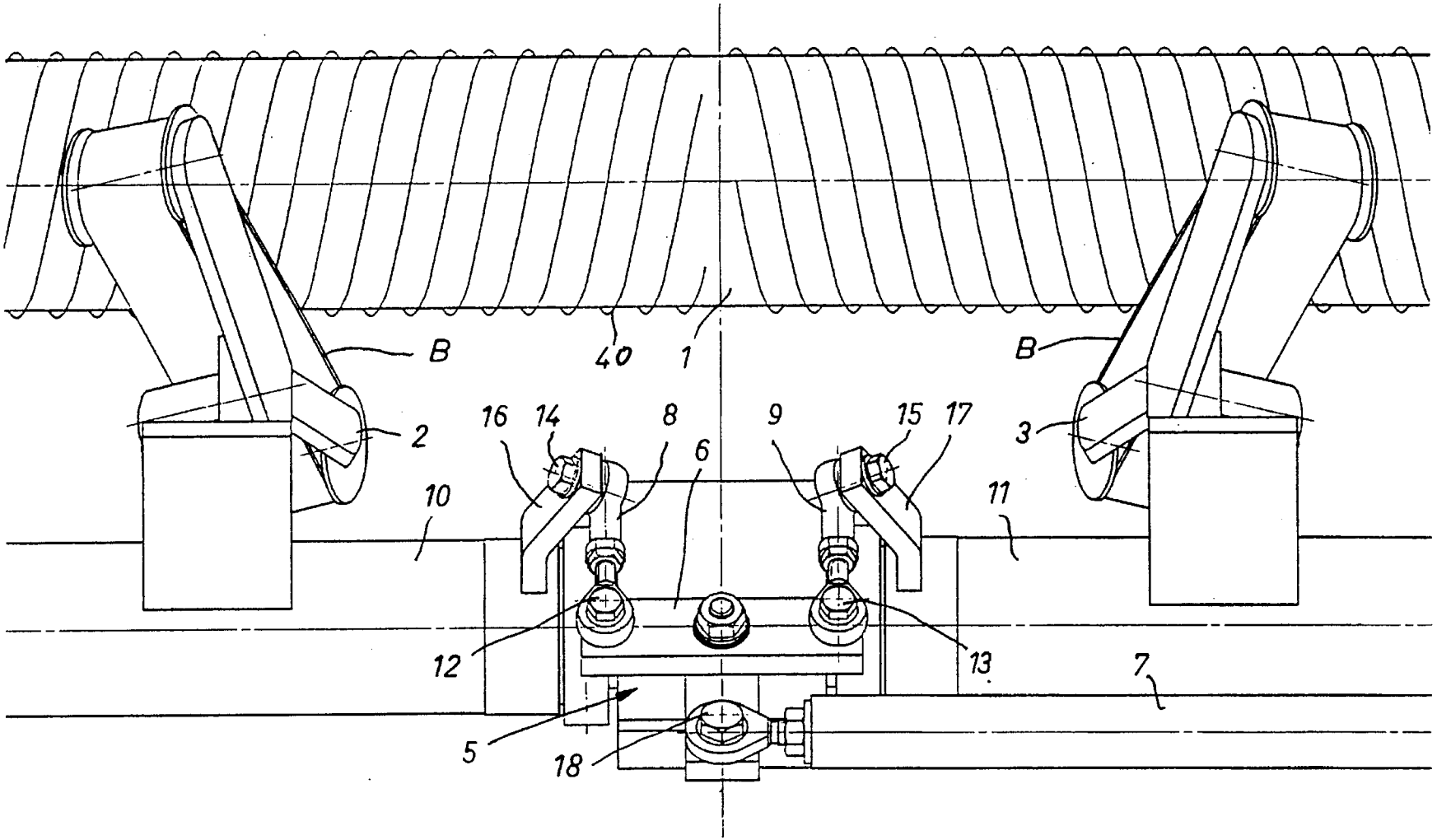
FIG. 3 shows an enlarged cutout of FIG. 1 with the mechanical coupling of the contact pressure elements.

FIG. 3 shows that the coupling device 5 is formed by a rotary part 6, which is rotatably supported on a pivot 18, and this rotary part in turn is connected with the control member 4 (not shown here) via a thrust bar 7. The rotary part 6 translates the thrust movement produced by the control member 4 into an oppositely directed, synchronous rotary motion of the two control bars 8, 9, which are connected with the rotary part via the joints 12, 13. The control bars 8, 9 put the supporting elements 10, 11 which are designed as shafts—into a rotary motion in the opposite direction via the jibs 16, 17 and the joints 14, 15 mounted in the bars. The rotary motion is directly transmitted to the contact pressure elements 2, 3. Any approaching of the contact pressure elements 2 toward the spreading roll 1 in the left material web edge zone $K_1$, causes an equally dimensioned distance of the contact pressure elements 3 from the spreading roll 1 in the right material web edge zone $K_2'$.

So that the material web edges $K_1$, $K_2$ remain as closely as possible adjacent to their desired positions, it is necessary that a controlling system R detects the edge position $K_1'$, $K_2$ of the material web W and acts on the control member 4, so that any deviation of the material web edge position $K_1$, $K_2$ from the desired position is controlled as quickly as possible and the material web W is subsequently kept stable in the desired position. According to the invention, this is accomplished by the control systems R, R' shown respectively in FIGS. 4 and 5.

Figure 4:
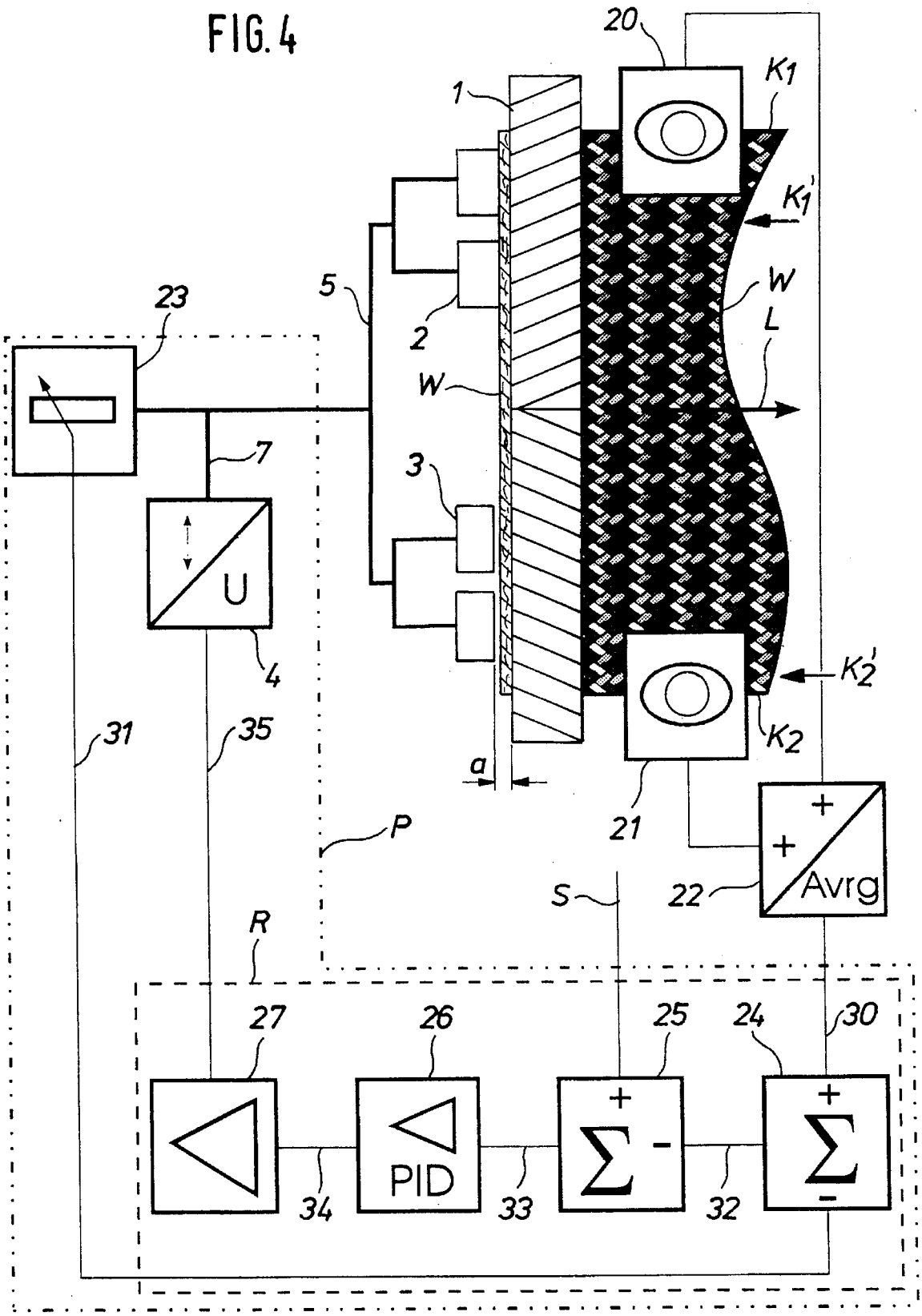
FIG. 4 shows a single-loop control circuit for the spreading and guiding device.

FIG. 4 schematically shows a preferred positioning device P, which influences the control path via a variation of the spacing a of the contact pressure elements 2, 3 from the spreading roll 1. A scanning device 20, 21 is present on the two material web edges $K_1$, $K_2$, which scanning devices detect the positions of the material web edges $K_1$, $K_2$. These scanning devices preferably are designed as wide-band proportional sensors. Their signals are supplied to the mean-value detector 22, which based on such signals determines the actual value of the position of the centerline of the material web W and, via its output (signal path 30), supplies such actual value to the actual value input of a control system R. Alternatively, it is possible in another embodiment to scan only one material web edge $K_1$, and to supply this signal-amplified, if need be, to the control system R via the signal path 30. Likewise, it is possible in a further embodiment to make provision for an independent positioning system for each material web edge $K_1$, $K_2$, with such system comprising a scanning device 20, 21, and a control system R with a control member 4, which is advantageous mainly with wide-mesh webs of material.

A path generator 23 detects the position of the contact pressure elements 2, 3 with respect to the spreading roll 1, and supplies such position with feedback and amplified, if necessary, to the control system R via a signal path 31. A rapid and finely tuned control of the web guidance takes place in this way. The control system R substantially comprises the two adders 24, 25, as well as of a controller 26, for example with P-, PI- or PID-mode, and the power amplifier 27 connected downstream, the latter supplying the power required for actuating the control member 4. The adder 24 first links the actual value of the material web edge position, this value being supplied by the mean-value detector 22 via the signal path 30, with the position of the contact pressure elements, which are supplied via the signal path 31. The corrected actual value resulting therefrom is compared with the constant desired value S via the signal path 32 in the adder 25, and supplied to the controller 26 via the signal path 33 as the control deviation. This controller 26 supplies at its output a correction signal, which is supplied to the power amplifier 27 via the signal path 34 and amplified to such a degree that the control member 4 can be controlled via the signal path 35.

In this connection, the control member 4 transforms the output voltage or output current of the power amplifier 27 into the motion of a mechanical component. Preferably, electric motors, linear motors, stepping motors, magnets, piezo-drives, or hydraulic or pneumatic components are used for this purpose, together with electrically operable valves. Via the thrust bar 7, the control member 4 acts on the coupling device 5 in such a way that the contact pressure elements are moved in opposite directions. The special advantage of this control system R is based on the fact that only one control loop is present, thus permitting a simple balancing of the control parameters.

Figure 5:
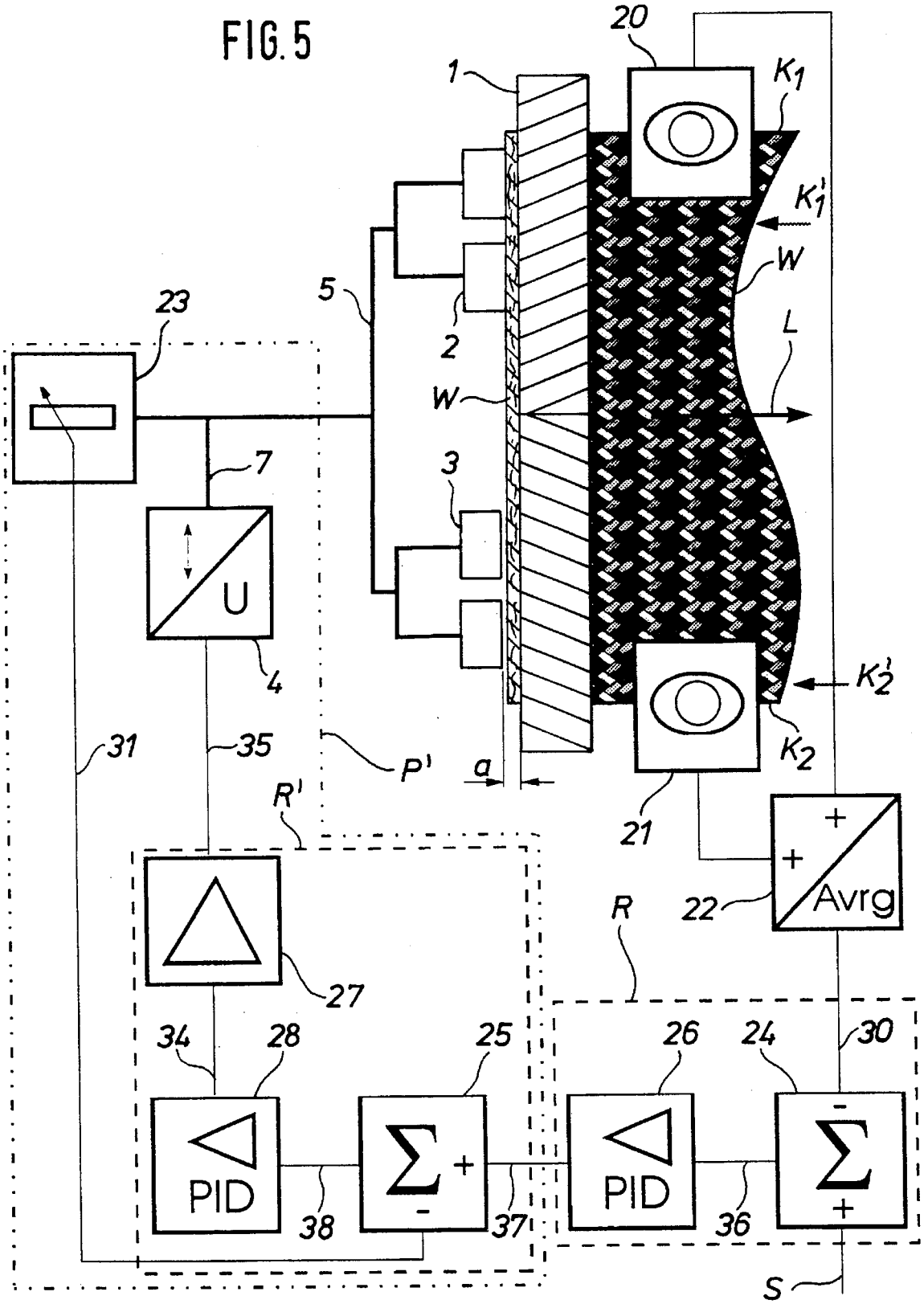
FIG. 5 shows a two-loop control circuit for the spreading and guiding device.

FIG. 5 shows the possible realization of the positioning device P' as a two-loop controller including the control systems R, R'. In this case too, the material web edges $K_1$, $K_2$ are detected by the scanning devices 20, 21 and supplied to the mean-value detector 22. By way of the signal path 30, the actual value of the material web position $K_1$, $K_2$ so determined is supplied to the outer control loop comprising the adder 24, the controller 26, the control system R' and the control member 4. The adder 24 compares the actual value received via the signal path 30 with the constant preset desired reference value S and, via the signal path 36, transmits said control deviation to the controller 26 with, for example P-, PL- or PID-mode. The controller 26 determines a correction value for the required spacing "a" of the contact pressure elements 2, 3 from the spreading roll 1 at its output to the signal path 37. The inner control loop is made up of the path generator 23, which measures the position of the contact pressure elements 2, 3, the adder 25, the controller 28, the power amplifier 27, and the control member 4, which, via the thrust bar 7 and the rotary part 6, is mechanically connected with the contact pressure elements 2 and 3. The adder 25 compares the spacing "a" of the contact pressure elements 2, 3, this spacing being measured by the path generator 23 and received via the signal path 31, with the reference value received via the signal path 37, this reference value being the correction signal of the control system R. The comparative value, which is the control deviation, is passed on to the controller 28 with, for example P-, PI- or PID-mode, by way of the signal path 38. Via the signal path 34, the correction signal determined by the controller 28 is amplified in the power amplifier to such a degree that the control member 4 can be controlled by way of the signal path 35.

This two-loop control requires more expenditure, technically speaking, and particularly requires adjustment of the parameters of the controllers 26 and 28; however, it offers the advantage of a more rapid control. The control route made up of the path generator 23 and the control member 4 generally shows less sluggishness than the control route made up of the scanning devices 20, 21 and the control member 4. If external disturbances not relating to the positions of the material web edges occur, such as, for example local thickening of the material web W, such control deviation is controlled by the inner control circuit forming the positioning device P at a much higher rate than would be possible by the outer control circuit containing the control systems R, R'. Thus the embodiment of the control system R, R' according to FIG. 5 exhibits a particularly favorable control behavior.

While only several embodiments of the present invention have been shown and described, it is to be understood that many changes and modifications may be made thereunto without departing from the spirit and scope of the invention as defined in the appended claims.

What is claimed is:

1. Process for guiding and keeping a material web spread out, with a spreading roll covered by oppositely orientated thread turns, said thread turns starting from the center and with spaced contact pressure elements acting on the material web, comprising pressing the material web against the spreading roll using the contact pressure elements and, at the same time, producing forces directed to edges of the material web;

detecting the position of the contact pressure elements and generating a signal indicative of said position;

detecting the edge position of the material web and generating a signal indicative of said edge position; and changing the spacing of the contact pressure elements from the spreading roll in such a way that the edge position of the material web is controlled and maintained as closely as possible to a preset desired value, and said controlling of the material web being based upon the signals indicative of said edge position of the material web and said detected position of the contact pressure elements.

2. Process according to claim 1, further comprising two edge zones one for each edge of the material web; and the sum of the spacings of the contact pressure elements from the spreading roll remains constant in both edge zones.

3. Device for guiding and keeping a material web spread out, said material web having two edges and having two edge zones, comprising a spreading roll, that spreading roll being covered by oppositely orientated thread turns, the thread turns starting from the center of the spreading roll;

contact pressure elements acting on said roll, said contact pressure elements being present in both edge zones and generating forces directed at the corresponding edges;

at least one scanning device generating correction signals proportional to a detected edge position of the material web;

a positioning device having a path generator detecting the position of the contact pressure elements and generating a signal indicative of said position;

said positioning device including a control member;

said contact pressure elements provided in both edge zones are mechanically connected with said positioning device;

a control system responsive to said signal of said path generator and to said correction signals of said scanning device; and whereby the control system is actively connected with a control member of the positioning device.

4. Device according to claim 3, further comprising a positioning device in each of the two edge zones; means for linking said positioning devices with each other in a way such that the contact pressure elements are synchronously adjustable in opposite directions.

5. Device according to claim 3, comprising a control member of one single positioning device mechanically connected to said contact pressure elements of both edge zones in a synchronous mode of operation in opposite directions.

6. Device according to claim 5, comprising a coupling connection to the contact pressure elements of both edge zones; and said coupling connection having a centrally supported rotary part and being actively connected with the control member.

7. Device according to claim 6, comprising wherein the rotary part has free ends and at its free ends, said rotary part is actively connected via jointly supported control bars with contact pressure elements rotatably supported on an axle.

8. Device according to claim 5, comprising an adder computing a corrected actual-value and is, via signal paths actively connected to at least one scanning device; said scanning device generating correction signals proportional to the edge position, as well as to at least one path generator;

said path generator detecting the position of the contact pressure elements, an output signal of said adder being actively connected via a signal path to a second adder comparing the actual value with a desired preset value; and the output signal of said adder being actively connected via a signal path to a controller influencing the control member via a power amplifier.

9. Device according to claim 3, comprising means for steplessly adjusting the positioning device.

10. Device according to claim 3, comprising at least one positioning device being an independent control system comprising a path generator, an adder, and a controller with at least one control member controlled via a power amplifier;

said control system being via a signal path actively connected to the control system influenced by the correction signals of the scanning device.

11. Process for guiding and keeping a material web spread out, with a spreading roll covered by oppositely oriented thread turns, said thread turns starting from the center and with spaced contact pressure elements acting on the material web, comprising pressing the material web against the spreading roll using the contact pressure elements and, at the same time, producing forces directed to edges of the material web;

detecting the position of the contact pressure elements and generating a signal indicative of said position;

detecting the edge position of the material web and generating a signal indicative of said edge position; and changing the spacing of the contact pressure elements from the spreading roll in such a way that the edge position of the material web is controlled and maintained as closely as possible to a preset desired value, and said controlling of the material web being based upon the signals indicative of said edge position of the material web and said detected position of the contact pressure elements;

one edge zone and another edge zone; and changing the spacing of the contact pressure elements from the spreading roll in one edge zone of the material web to a higher degree than the spacing of the contact pressure elements from the spreading roll in another edge zone.

12. Process according to claim 11, wherein for the two edge zones, there is one for each edge of the material web; and the sum of the spacings of the contact pressure elements from the spreading roll remains constant in both edge zones.

13. Device for guiding and keeping a material web spread out, said material web having two edges and having two edge zones, comprising a spreading roll, that spreading roll being covered by oppositely oriented thread turns, the thread turns starting from the center of the spreading roll;

contact pressure elements acting on said roll, said contact pressure elements being present in both edge zones and generating forces directed at the corresponding edges;

at least one scanning device generating correction signals proportional to a detected edge position of the material web;

a positioning device having a path generator detecting the position of the contact pressure elements and generating a signal indicative of said position;

said positioning device including a control member;

said contact pressure elements provided in both edge zones are mechanically connected with said positioning device;

a control system responsive to said signal of said path generator and to said correction signals of said scanning device;

whereby the control system is actively connected with a control member of the positioning device; and wherein several contact pressure elements are present in each of the two edge zones; said elements being connected via supporting elements in a way such that all contact pressure elements of an edge zone have the same or, with increasing distance from the corresponding edge, an increasing spacing from the spreading roll.

14. Device according to claim 13, further comprising a positioning device in each of the two edge zones; means for linking said positioning devices with each other in a way such that the contact pressure elements are synchronously adjustable in opposite directions.

15. Device according to claim 13, comprising a control member of one single positioning device mechanically connected to said contact pressure elements of both edge zones in a synchronous mode of operation in opposite directions.

16. Device according to claim 15, comprising a coupling connection connected to the contact pressure elements of both edge zones; and said coupling connection having a centrally supported rotary part and being actively connected with the control member.

17. Device according to claim 16, comprising wherein the rotary part has free ends and at its free ends, said rotary part is actively connected via jointly supported control bars with contact pressure elements rotatably supported on an axle.

18. Device according to claim 15 comprising an adder computing a corrected actual-value is, via signal paths actively connected to at least one scanning device; said scanning device generating correction signals proportional to the edge position, as well as to at least one path generator;

said path generator detecting the position of the contact pressure elements, an output signal of said adder being actively connected via a signal path to a second adder comparing that actual value with a desired preset value; and the output signal of said adder being actively connected via a signal path to a controller influencing the control member via a power amplifier.

19. Device according to claim 13, comprising means for steplessly adjusting the positioning device.

20. Device according to claim 13, comprising at least one positioning device being an independent control system comprising a path generator, an adder, and a controller with at least one control member controlled via a power amplifier; and said control system being via a signal path actively connected to the control system influenced by the correction signals of the scanning device.

* * * * *